United States Patent [19]

Davidson

[11] Patent Number: 4,547,110

[45] Date of Patent: Oct. 15, 1985

[54] OIL WELL DRILLING RIG ASSEMBLY AND APPARATUS THEREFOR

[75] Inventor: Alvin L. Davidson, Taber, Canada

[73] Assignee: Guy E. Lane, Medicine Hat, Canada

[21] Appl. No.: 491,096

[22] Filed: May 3, 1983

[51] Int. Cl.[4] ..... E21B 19/14

[52] U.S. Cl. ..... 414/22; 294/104; 414/748; 414/719

[58] Field of Search ..... 414/22, 719, 720, 745, 414/748; 294/104, 106, DIG. 2; 175/52, 85; 166/77.5

[56] References Cited

U.S. PATENT DOCUMENTS

| | | | |
|---|---|---|---|
| Re. 26,284 | 10/1967 | O'Neill et al. | 175/85 X |
| 2,816,793 | 12/1957 | Elberty | 294/106 |
| 3,165,347 | 1/1965 | Keskitalo | 294/104 X |
| 3,177,944 | 4/1965 | Knights | 175/85 X |
| 3,280,920 | 10/1966 | Scott | 414/22 X |
| 3,365,085 | 1/1968 | Wilson | 414/22 X |
| 3,613,905 | 10/1971 | Woolslayer et al. | 414/22 |
| 3,633,771 | 1/1972 | Woolslayer et al. | 414/22 X |
| 3,702,640 | 11/1972 | Cintract et al. | 414/22 X |
| 3,734,210 | 5/1973 | Wilderman | 414/22 X |
| 3,840,128 | 10/1974 | Swoboda et al. | 294/104 X |
| 3,937,515 | 2/1976 | Langowski | 414/22 X |
| 4,051,956 | 10/1977 | Teague | 414/22 X |
| 4,054,210 | 10/1977 | Crocker | 414/748 X |
| 4,109,800 | 8/1978 | Howard et al. | 414/22 |
| 4,172,684 | 10/1979 | Jenkins | 414/22 |
| 4,403,897 | 9/1983 | Willis | 414/22 |
| 4,407,629 | 10/1983 | Willis | 414/22 X |

FOREIGN PATENT DOCUMENTS

| | | | |
|---|---|---|---|
| 2721342 | 11/1978 | Fed. Rep. of Germany | 175/85 |
| 52-37376 | 3/1977 | Japan | 414/748 |

*Primary Examiner*—Leslie J. Paperner

*Attorney, Agent, or Firm*—Oldham, Oldham & Weber Co.

[57] ABSTRACT

An oil well drilling rig assembly having a main drilling mast which receives and installs sections of drill pipe. A pipe supply mast is pivotally mounted in a spaced relationship from the base of the main mast to provide a safe catwalk area therebetween. The supply mast is movable between a horizontal position for transferring pipe sections between an adjacent pipe supply rack and a vertical position adjacent the main mast for transferring a section of pipe therebetween. The supply mast is raised and lowered by hydraulic cylinders and is telescopically adjustable to various lengths. A combination shock absorbing bumper and alignment arrangement is provided between the mast drill mast and the pipe clamps on the supply mast. The supply mast is provided with a plurality of pipe clamps for releasably clamping a section of pipe on the supply mast. The clamps are provided with adjustable jaws which maintain the axial centerline for clamped pipes of various diameters. The pipe clamps are controlled by pressure actuated cylinders to regulate the clamping pressure in relationship to the thickness and strength of the pipe wall. Pipe sections are transferred individually between a sloped storage rack and the supply mast by indexing wheels. A pair of power drive pickup arms also transfer pipe sections between the storage rack and supply mast.

2 Claims, 14 Drawing Figures

OIL WELL DRILLING RIG ASSEMBLY AND APPARATUS THEREFOR

TECHNICAL FIELD

The invention relates to oil well drilling rig assemblies and in particular to an arrangement for transferring sections of drill pipe between a supply of such pipe to a position adjacent the main drill mast. Furthermore, the invention relates to an improved clamping mechanism on the supply mast for releasably clamping the pipe sections thereon for transfer between the main mast and supply racks.

BACKGROUND ART

Various mechanisms have been devised for transferring sections of drill pipe between a supply of such pipe and the main drill mast for either installing the pipe sections in the drill oil or for pulling the sections from the well. These prior pipe transfer devices move the pipe from its normal horizontal stored position adjacent the base of the main drill mast or derrick to a vertical position for installation in the drill hole by the equipment mounted on the main mast. Examples of such prior transfer masts and associated equipment are shown in U.S. Pat. Nos. 3,177,944; 3,613,905; 3,633,771; 3,702,640; 4,109,800; and 4,172,684.

Although these prior constructions may perform satisfactorily, they are relatively expensive and difficult to operate and provide a safety problem in that movement of the supply mast or pipe transfer device toward the main drill mast, a workman in the vicinity between the main mast and pipe supply apparatus could be crushed.

A further problem with known pipe transfer devices is the inability of the device to accommodate pipes of various size diameters. Although certain transfer devices have adjustable clamps, the centerline of the pipe with respect to the transfer mechanism will vary depending upon the size of the pipe. This presents alignment problems when the pipe is raised to a pipe installation position with the main mast due to the relocation of the supply pipe centerline. A still further problem with known pipe clamps is that the clamping pressure can damage the pipes secured thereby where relatively thin-walled pipe is used for a particular well installation is contrast to other installations using a heavy-walled pipe. Heretofore the clamps will maintain a constant clamping force regardless of the size and wall thickness of the pipe being clamped thereby.

A further problem with known drilling mast assemblies is that the pipe sections may require manual movement and relocation for placing the pipe sections on the transfer mechanism, all of which increases the number of men required at a drill site as well as the amount of time for loading or unloading the transfer mechanism with a pipe section. Furthermore, this manual handling of the pipe increases the safety risk for the workmen.

Another problem with prior drill assemblies having pipe transfer devices is that the pipe sections are stored on the drilling platform or in the main drilling mast increasing the danger to the workmen and possible damage to the equipment, especially when high winds are encountered due to the excess weight at an elevated position and resulting moment force that is applied to the base of the drilling mast. Therefore, there is the need for an improved drilling mast assembly and pipe transfer mechanism which eliminates these problems which have existed in the art.

DISCLOSURE OF INVENTION

Objectives of the invention include providing an improved oil well drilling assembly having an improved transfer mast for transferring sections of pipe between the main derrick, and a horizontal position adjacent a storage rack in a safe manner; and in which the transfer mast has an offset base mounting arrangement which provides a sufficient spacing from the base of the main mast when in a raised position forming a catwalk between the main mast and supply mast preventing a workman from being crushed therebetween as in some prior constructions. Another objective is to provide such assembly in which the supply mast is raised and lowered by telescopically extendable and retractable cylinders providing for a controlled, smooth movement of the mast; in which improved pipe clamping members are mounted on the supply mast; and in which the supply mast is formed by telescopically extendable members to permit adjustment to the length of the mast to match the particular length of the pipe sections being transferred thereby.

A further objective of the invention is to provide an improved clamping mechanism for the transfer mast which is adjustable to accommodate pipe sections of different diameters while maintaining the same axial centerline of the pipe with respect to the mast whereby the pipe sections remain axially aligned with the centerline of the main drilling mast when raised to the vertical position; and in which the clamping pressure of the pipe clamps is adjustable to conform with the thickness and strength of the pipe walls to adequately grip the pipe sections to prevent rotation thereof when being installed in the main drill pipe string, without damaging the pipe walls by excessive clamping pressure.

A still further objective of the invention is to provide such an assembly in which the pipe sections are loaded automatically onto the pipe clamps of the transfer mast from either side of the supply mast either by a pair of power-driven pickup arms which will raise the pipe sections from a lower level on a trailer and place the same onto the clamps, or by means of a pair of spaced indexing wheels which automatically discharges individual pipes from a sloped supply trailer onto the clamps; and in which the indexing wheels are power driven by a pressure cylinder enabling the pipes to be transferred from the mast onto the trailer in a reverse operation, if desired.

A still further objective of the invention is to provide such a drilling assembly and transfer mast which eliminates the storage of the pipe sections on the main drilling mast or drilling platform thereby increasing the safety to the workmen and drilling equipment, which eliminates manual transfer or placement of the pipe sections onto and off of the transfer mast, and in which an improved shock absorbing alignment mechanism is provided by the supply mast clamps in combination with the main drill mast to automatically center the supply mast with respect to the open side of the main drill mast for transferring the pipe sections therebetween.

A further objective of the invention provides such an improved drilling mast assembly which reduces the number of workmen required at a drill site; provides a less expensive drilling unit; reducing the expense and time required for installing and removing sections of drill pipe from a well hole; increases the safety for the workmen; and reduces problems existing in the well drilling art and solves problems that have long existed in the art.

These objectives and advantages are obtained by the improved well drilling assembly, the general nature of which may be stated as including a main drilling mast having a base and an upper structure, said upper structure being adapted to receive sections of drill pipe; a pipe supply mast adapted to releasably hold a section of drill pipe, said supply mast having upper, intermediate and lower sections, said lower section being pivotally mounted in a spaced relationship from the base of the main mast for movement between a horizontal pipe receiving position and a raised pipe discharge position; storage rack means for holding a plurality of drill pipe sections; and pipe dispensing means operatively communicating with the pipe supply mast and storage rack means for individually dispensing a pipe section onto the upper section of the pipe supply mast when said supply mast is in a horizontal position for subsequent delivery by the supply mast to the upper structure of the main drilling mast.

BRIEF DESCRIPTION OF DRAWINGS

A preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

BEST MODE FOR CARRYING OUT INVENTION

Figure 1:
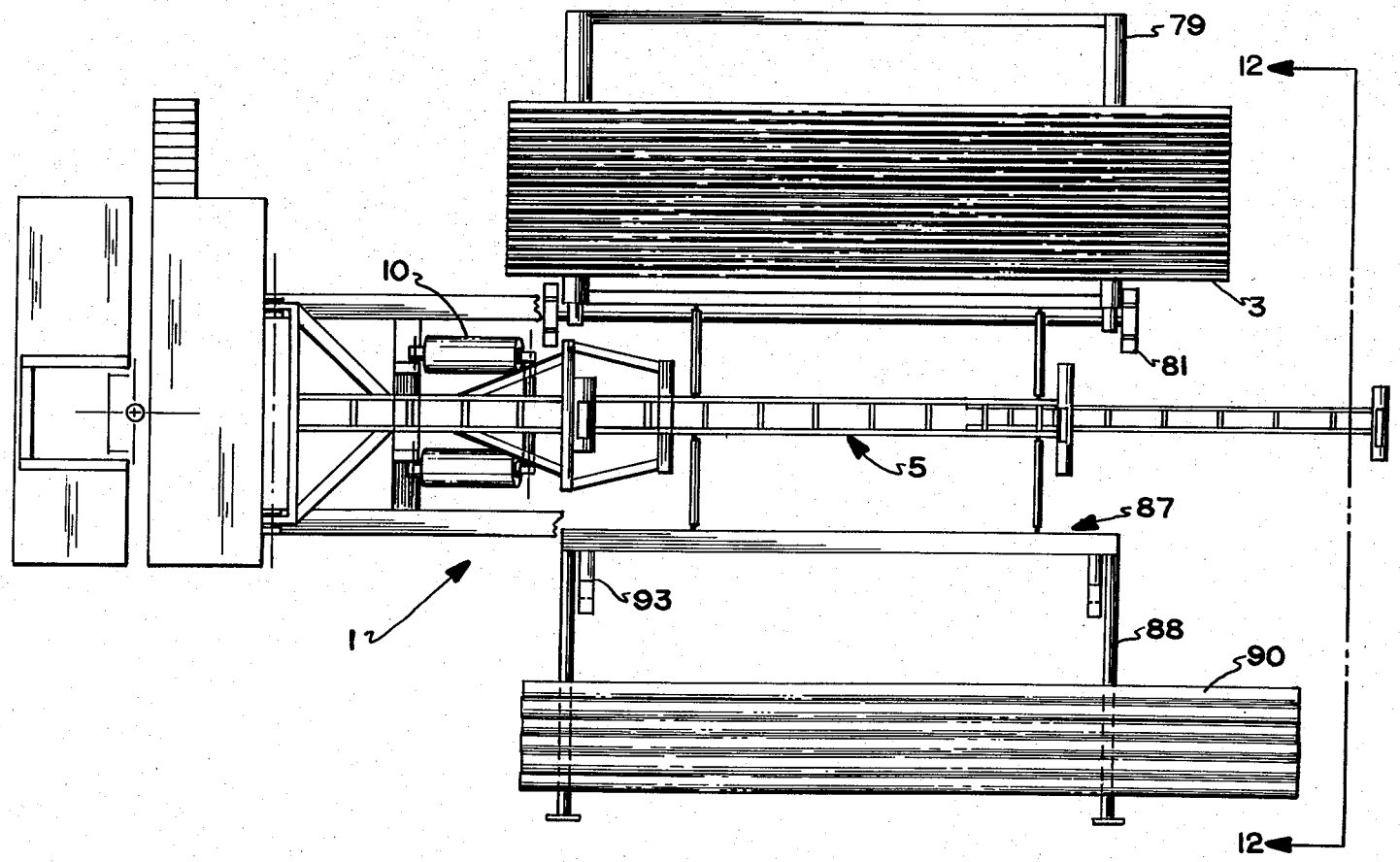
FIG. 1 is a diagrammatic top plan view showing the improved well drilling assembly with the pipe supply mast being in a horizontal, lowered position located between storage racks containing sections of drill pipe and pipe casing.
Figure 2:
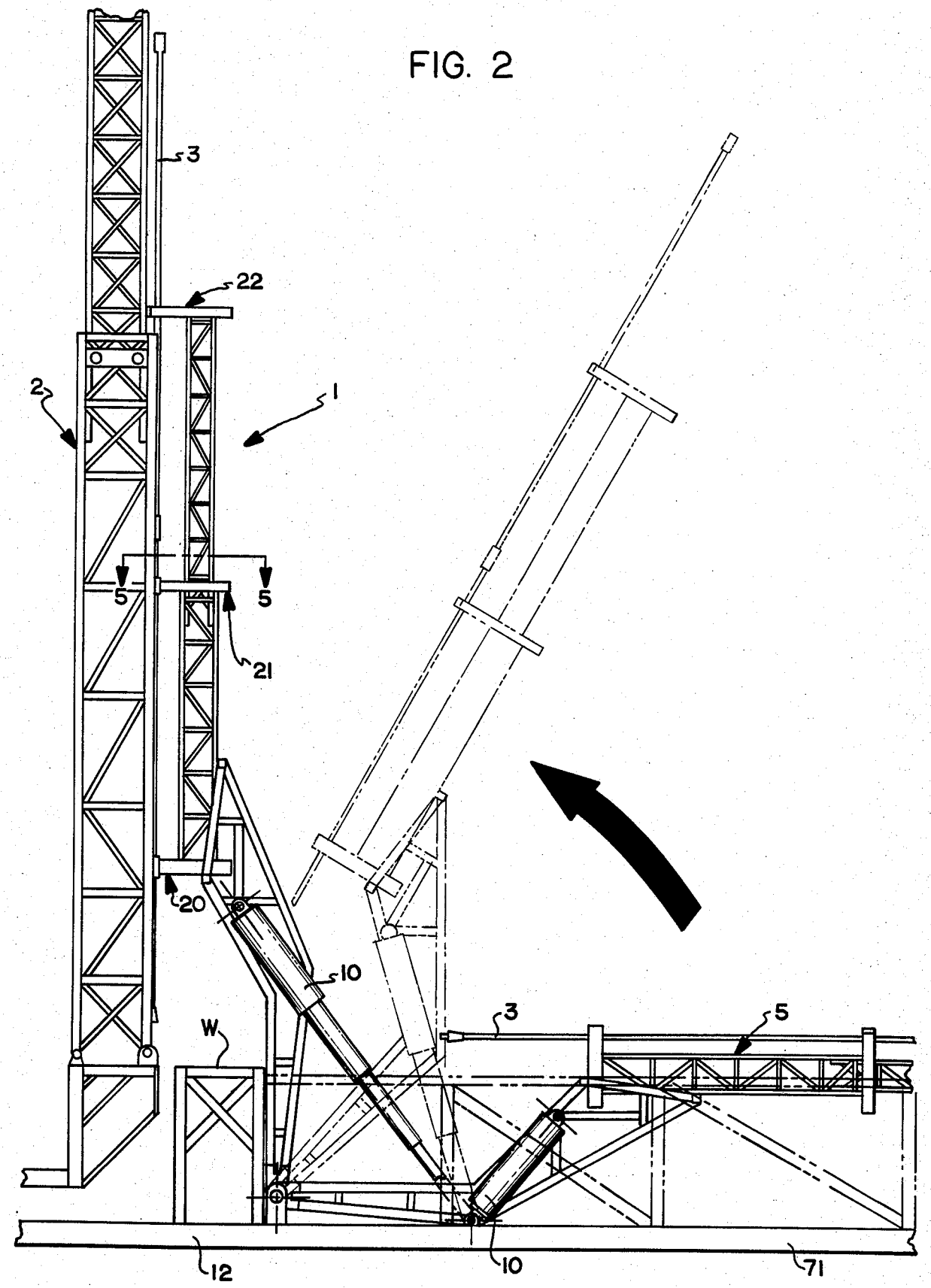
FIG. 2 is a diagrammatic side elevational view showing the main drill mast in a vertical raised position and the supply mast in full lines in a horizontal pipe receiving position and in a raised vertical position engaged with the main drill mast, with an intermediate position of the supply mast being shown in dot dash lines.
Figure 4:
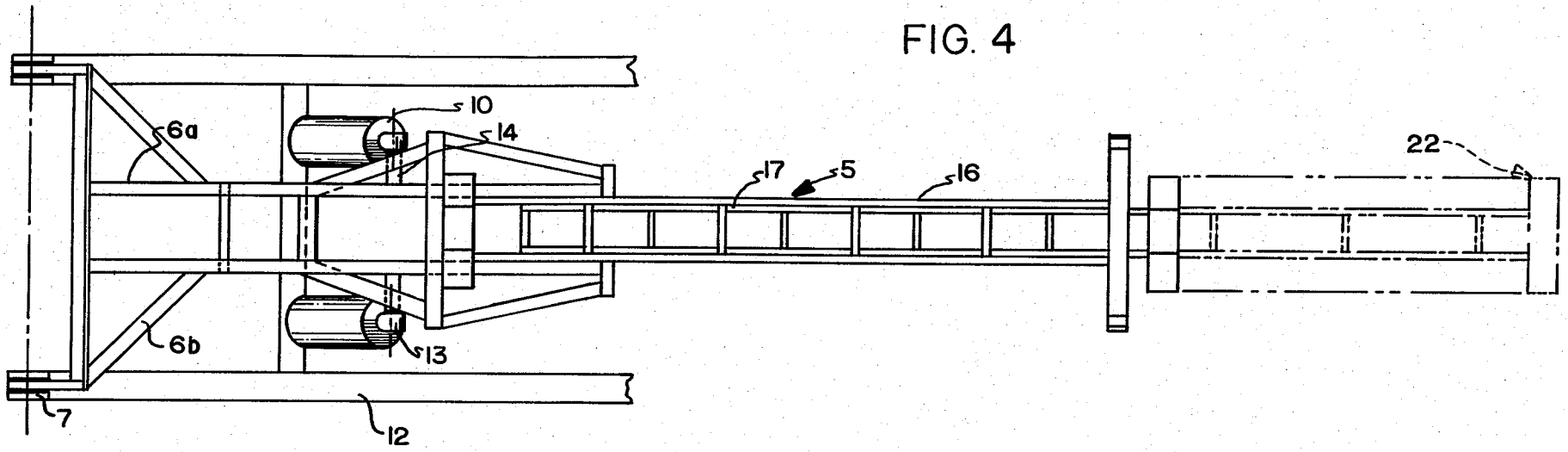
FIG. 4 is a top plan view of the pipe supply mast of FIG. 3.
Figure 3:
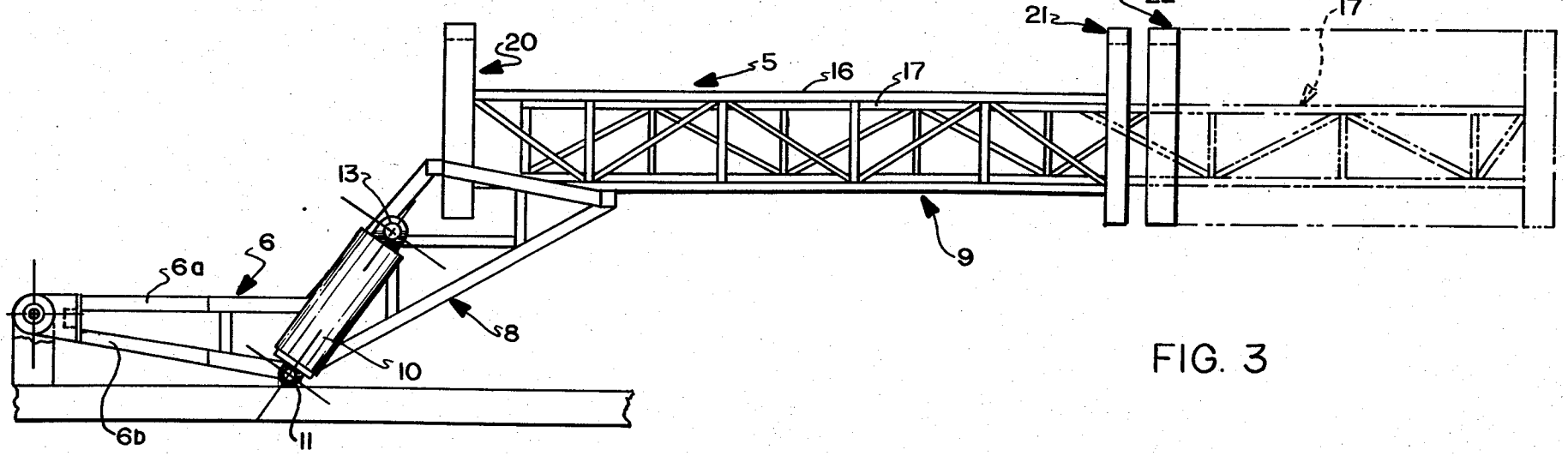
FIG. 3 is a side elevational view of the pipe supply mast in a horizontal pipe receiving position with the extended end of the mast being shown in dot dash lines in an outwardly adjusted position.

The improved oil well drilling assembly is indicated generally at 1, and is shown diagrammatically in FIGS. 1 and 2. Assembly 1 includes a main drilling mast indicated generally at 2, which received sections of drill pipe 3 for placing the same in a drilled well hole in a usual manner. An improved pipe supply mast is indicated generally at 5, and is shown in detail in FIGS. 3 and 4. Supply mast 5 includes a lower section 6 which is pivotally mounted on a pair of pivot blocks 7, an intermediate section 8, and a top section 9. Lower section 6 is formed by a plurality of structural members *6a* and *6b* and extends generally parallel with upper section 9 with intermediate section 8 extending in an angled fashion therebetween.

Supply mast 5 is raised by a pair of hydraulic cylinders 10 between a lowered horizontal pipe receiving position and a vertical raised pipe discharged position, both of said positions being shown in full lines in FIG. 2. An intermediate supply mast position is shown in dot dash lines in FIG. 2. Cylinders 10 have a telescopically expandable and retractable construction to provide the necessary amount of swinging movement for moving supply mast 5 between the raised and lowered positions. The lower end of cylinders 10 will be pivotally mounted by pins 11 to a main support beam 12. The upper end of cylinders 10 are pivotally mounted by pins 13 to a brace 14 attached to intermediate mast section 8.

Upper mast section 9 preferably is formed by a pair of telescopically joined inner and outer sections 16 and 17 with outer section 17 being telescopically slidably mounted within inner section 16. This telescopic mounting arrangement enables supply mast 5 to accommodate various lengths of drill pipes 3 for transfer between main drilling mast 2. Outer section 17 is shown in an extended position by dot dash lines in FIGS. 3 and 4.

In accordance with one of the features of the invention, a plurality of pipe clamp mounting assemblies, indicated generally at 20, 21 and 22, are mounted on pipe supply mast 5 for releasably clamping a section of drill pipe 3 thereon for transferring the pipe between a horizontal lowered position and a vertical raised position adjacent main drilling mast 2. Pipe clamp mounting assemblies 20 and 21 are mounted on opposite ends of mast section 16 with mounting assembly 22 being mounted on the extended end of mast section 17.

Clamp mounting assemblies 20, 21 and 22 are generally similar to each other. Therefore only intermediate mounting assembly 21 is shown in detail in FIGS. 5 through 8 and FIG. 14. Assembly 21 includes a pair of spaced plates 24 formed with aligned rectangular-shaped openings 25 for receiving supply mast sections 16 and 17 therein. Mast section 16 is firmly attached to plates 27 with mast section 17 being slidably mounted with respect to the plates within mast section 16. Thus, plates 24 in addition to providing the support for mounting a pipe clamping mechanism thereon, also serves as the connection for telescopically slidably mounting inner mast section 17 within mast section 16.

Figure 5:
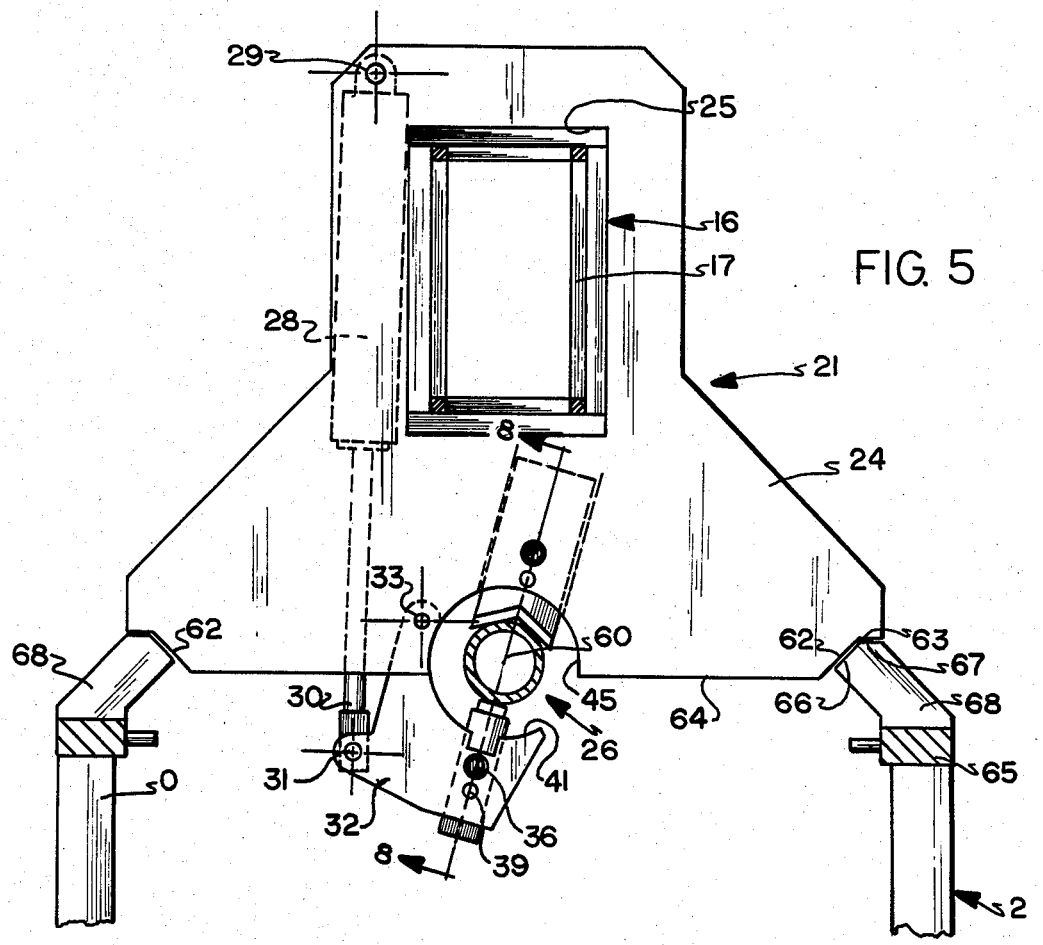
FIG. 5 is a sectional view taken on line 5—5, FIG. 2 showing one of the improved pipe clamping assemblies gripping a pipe which is shown in section, and also showing the improved shock absorbing and alignment mechanism.
Figure 6:
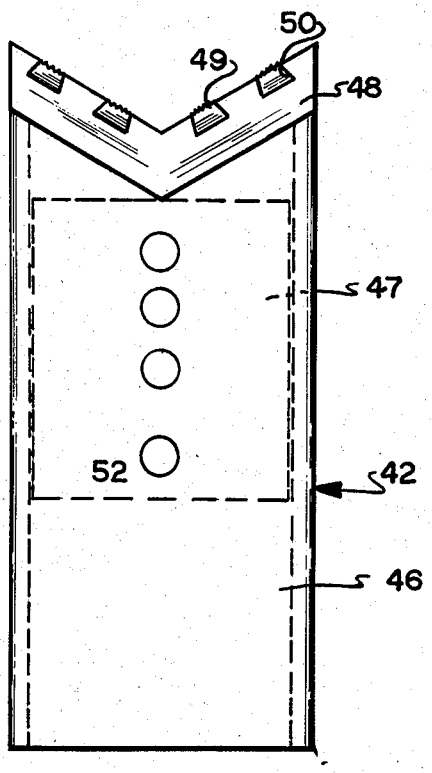
FIG. 6 is an enlarged view of the stationary pipe clamping jaw removed from the mounting plates.
Figure 7:
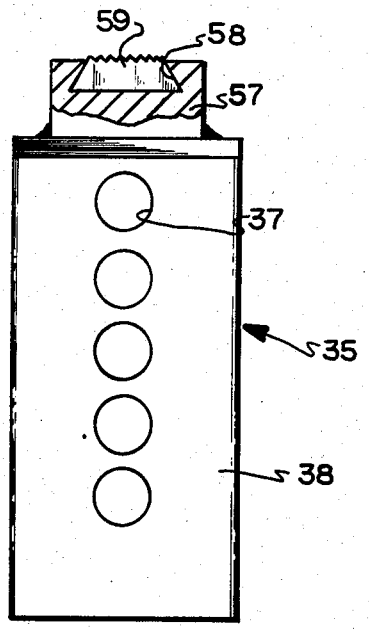
FIG. 7 is an enlarged view, portions of which are broken away and in section, showing the other of the pipe clamping jaws removed from the movable mounting plates.
Figure 8:
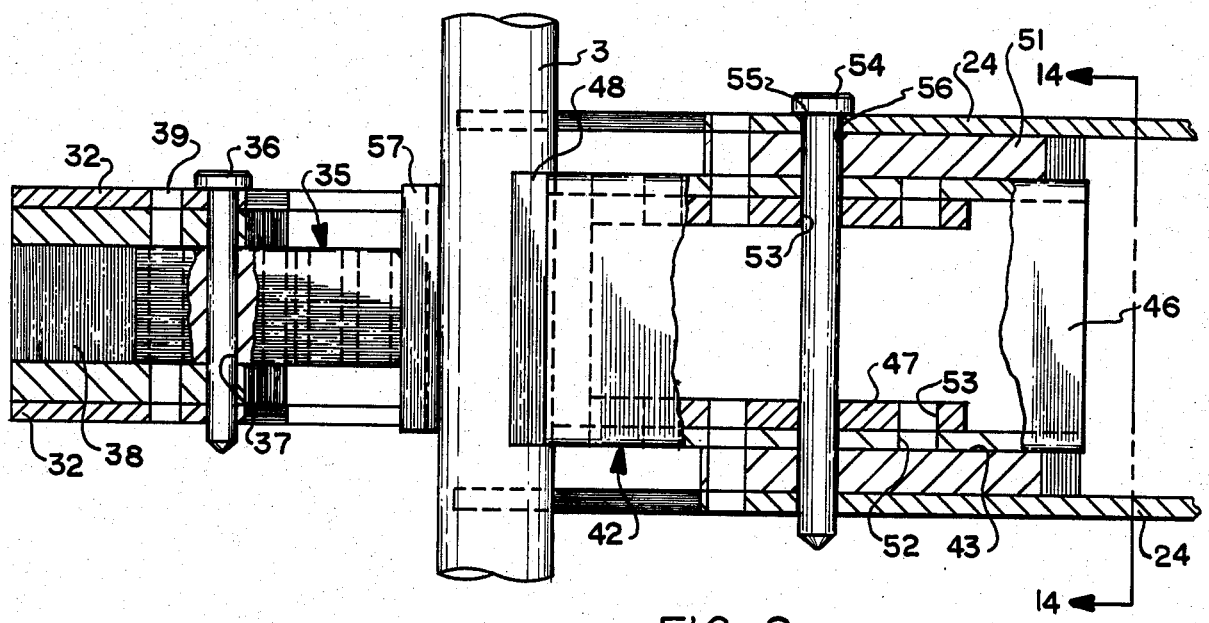
FIG. 8 is an enlarged fragmentary sectional view taken on line 8—8, FIG. 5.
Figure 14:
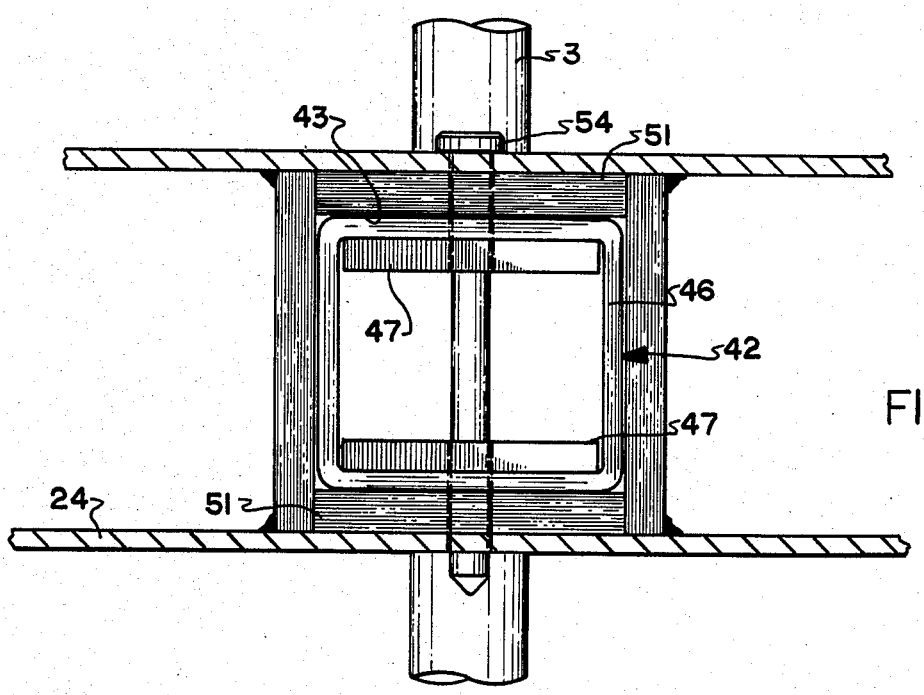
FIG. 14 is a sectional view taken on line 14—14, FIG. 8.
Figure 9:
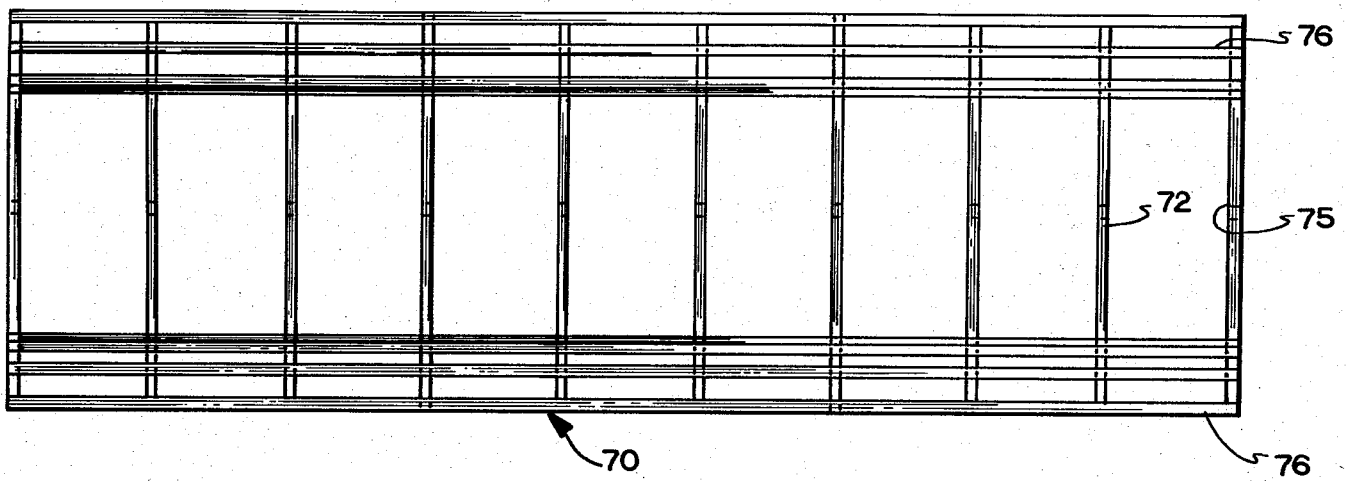
FIG. 9 is an enlarged top plan view of the support frame for the pipe supply mast which is shown in dot dash lines in FIG. 2.
Figure 11:
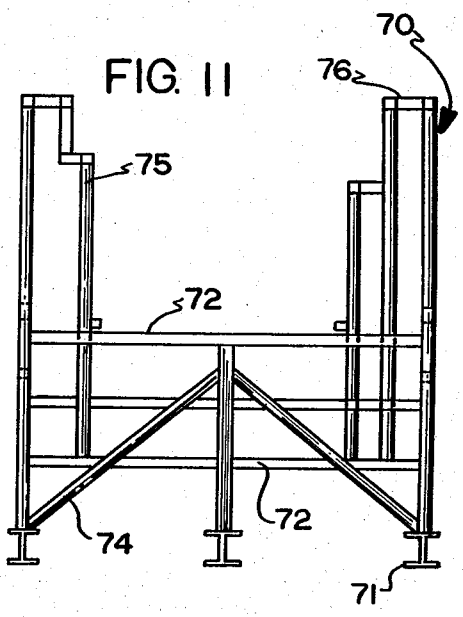
FIG. 11 is an end elevational view of the support frame of FIGS. 9 and 10.
Figure 10:
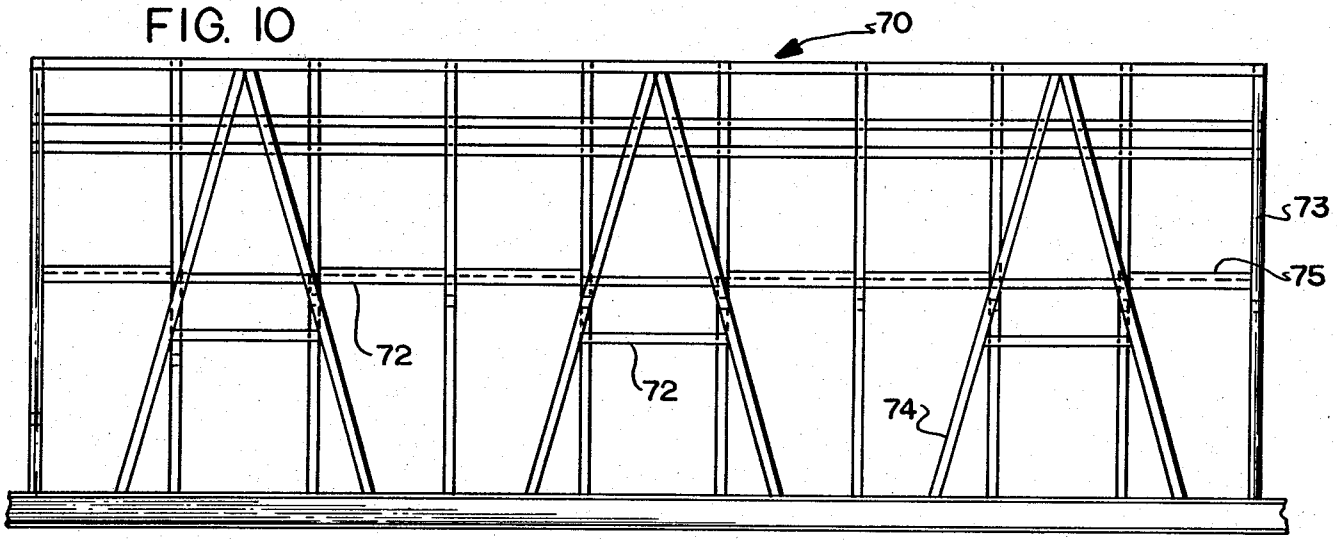
FIG. 10 is an elevational view of the support frame of FIG. 9.

A pipe clamping mechanism indicated generally at 26, is mounted on each pair of plates 24. Each mechanism 26 includes a pressure actuated cylinder 28 which is pivotally mounted by pin 29 on one end of plates 24 and is located in the space between the plates to protect the cylinder from damage or interference with other structures. Preferably cylinder 28 is pneumatically operated and is controlled from an operator control panel located on the drilling platform. Cylinder rod 30 is pivotally mounted by pin 31 between a pair of movable spaced pipe jaw holding plates 32 (FIGS. 5 and 8). Jaw plates 32 are pivotally mounted by a pin 33 between plates 24 adjacent semicylindrical-shaped recesses 45 formed in an end of plates 24. A pipe holding jaw indicated generally at 35 (FIGS. 7 and 8), has a generally T-shaped configuration and is slidably adjustably mounted between jaw holding plates 32 by a locking pin 36. A plurality of holes 37 are formed in the T-shaped base portion 38 of jaw 35 through which pin 36 is inserted when jaw hole 37 is aligned with one of a plurality of holes 39 formed in jaw holding plates 32 to maintain jaw 35 in the desired adjusted position.

Another pipe holding jaw indicated generally at 42 (FIGS. 6, 8 and 14), is adjustably mounted within a slide 43 formed between spaced plates 24 adjacent to and in communication with semicylindrical-shaped recesses 45 formed in the ends of plates 24. Pipe holding jaw 42 includes an outer, rectangular-shaped housing 46 having a pair of spaced internal reinforcing plates 47. A V-shaped top plate 48 is mounted on one end of housing 46 and has a plurality of spaced pipe gripping tong dies 49 slidably mounted within dovetail-shaped grooves 50 formed in top plate 48. Housing 46 and reinforcing plates 47 are formed with a plurality of aligned spaced holes 52 and 53 respectively. A locking pin 54 extends through holes 52 and 53 when aligned with holes 55 and 56 which are formed, in space plates 24 and inner slide plates 51, respectively, to lock jaw 42 in a predetermined pipe holding position. Plates 51 are firmly connected to welds or other fastening means to plates 24 to provide a slide for housing 46.

A tong die mounting block 57 is secured to the outer end of base 38 of jaw 35 (FIG. 7) and is formed with a dovetail-shaped groove 58 for slidably mounting a pipe gripping tong die 59 therein.

Pipe clamping mechanism 26 provides one of the improved advantages and features of drilling rig assembly 1 since it provides a constant centerline 60 (FIG. 5) for drill pipe 3 regardless of he particular diameter of the drill pipe. Jaws 35 and 42 are adjusted toward or away from a pipe section 3 depending upon the particular diameter of the pipe. The amount of adjustment is the same for both jaws thereby maintaining the pipe centerline 60 at the same position. This eliminates any additional realignment or manipulation of the pipe sections upon supply mast 5 being raised to the transfer position with drilling mast 2. Pipe section 3 will be firmly gripped by jaws 35 and 42 within a circular opening formed by semicircular recess 45 of plates 24 and semicircular recess 41 formed in jaw plates 32.

In accordance with another feature of the invention, the outer corners of plates 24 are formed with a pair of angled surfaces 62 which merge into surfaces 63 which are parallel with plate edges 64 (FIG. 5) for cooperative engagement with a pair of rubber blocks 68. Blocks 68 are secured to the outer frame members 65 of main drilling mast 2 and extend inwardly toward each other. Blocks 68 are provided with outer surfaces 66 and 67 which are complementary with plate edge surfaces 62 and 63, respectively. Thus, as clamping assemblies 20 and 21 approach main mast 2, angled surfaces 66 of rubber blocks 68 will engage angled surfaces 62 of plates 24 causing plates 24 to move transversely into correct alignment until surface 67 of blocks 68 engage complementary plate surfaces 63. This sliding movement between surfaces 62 and 66 will transversely align mast 5 with respect to main mast 2. In addition, rubber blocks 68 will stop the pivotal movement of mast 5 at the desired position against main mast 2 whereby centerline 60 of pipe section 3 will be at the desired position.

Thus, regardless of the number of times that transfer mast 5 is raised and lowered for transferring new pipe sections from a supply thereof to main mast 2, the centerline of the pipe section will remain constant due to adjustable pipe clamping mechanisms 26 and the self-aligning feature of rubber blocks 68. Likewise, in addition to aligning supply mast 5 with respect to mast 2, blocks 68 function as shock absorbers to absorb the impact energy of mast 5 as it engages mast 2.

Another advantage of improved pipe clamp mechanisms 26 is that the force exerted on cylinder rod 30 is adjustable whereby the pipe clamping pressure exerted by jaw 35 can be adjusted to a predetermined pressure. This prevents excess pressure being applied to a relatively thin wall pipe section 3 which could damage the same, and will enable sufficient clamping pressure to be exerted on a pipe section 3 preventing rotation thereof when a collar or other installation device is applied or removed from the pipe section. The pressure exerted on rod 30 is controlled easily from a control panel (not shown) which is located on the main mast platform through hydraulic or pneumatic lines extending thereto.

Pipe supply mast 5 is supported by a frame assembly indicated generally at 70, when in a horizontal pipe receiving position as shown particularly in FIGS. 9–12 and in dot dash lines in FIG. 2. Frame 70 is mounted on a plurality of spaced I-beam 71 and includes a latticework of vertical, horizontal and diagonal frame members 72, 73 and 74 respectively. Innermost vertical frame members 73 form a cradle opening 75 in which upper mast section 9 rests when in the horizontal position.

Another of the main features of improved oil well drilling assembly 1 is the mechanism for transferring sections of drill pipe 3 onto and off of pipe supply mast 5. This arrangement is shown particularly in FIGS. 1, 12 and 13. Drill pipes 3 are delivered to the well site on a pipe trailer 78 having a pipe rack 79. Rack 79 is movable vertically and at a forward or reverse inclined angle by a plurality of spaced hydraulic or pneumatic cylinders 80. A pair of indexing wheels 81 are mounted in a spaced relationship on a pivot rod 77 on one side of pipe trailer 78 by brackets 84 and are rotated by a pressure cylinder 82.

An individual pipe will by gravity roll into one quadrant 83 of indexing wheel 81. Actuation of cylinder 82 will rotate wheels 81 in a counterclockwise direction (FIG. 12) which will discharge pipe section 3 onto top frame members 76 of frame assembly 70 whereupon the pipe section will roll downwardly onto and across edges 64 of spaced plates 24 and onto V-shaped plate 48 of pipe clamping jaw 42 within recess 45. Cylinder 28 then is actuated pivotally moving clamping jaw 35 into engagement with pipe section 3.

Indexing wheels 81 also can be operated in reverse to move a pipe section from transfer mast 5 onto pipe trailer 80 when the pipe sections are being removed from a well. The right-hand end hydraulic cylinders 80 (FIG. 12) of pipe trailer 78 would slope pipe rack 79 in the opposite direction from that shown in FIG. 12 whereupon rotation of indexing wheels 81 in a clockwise direction will move the pipe onto the trailer.

Figure 12:
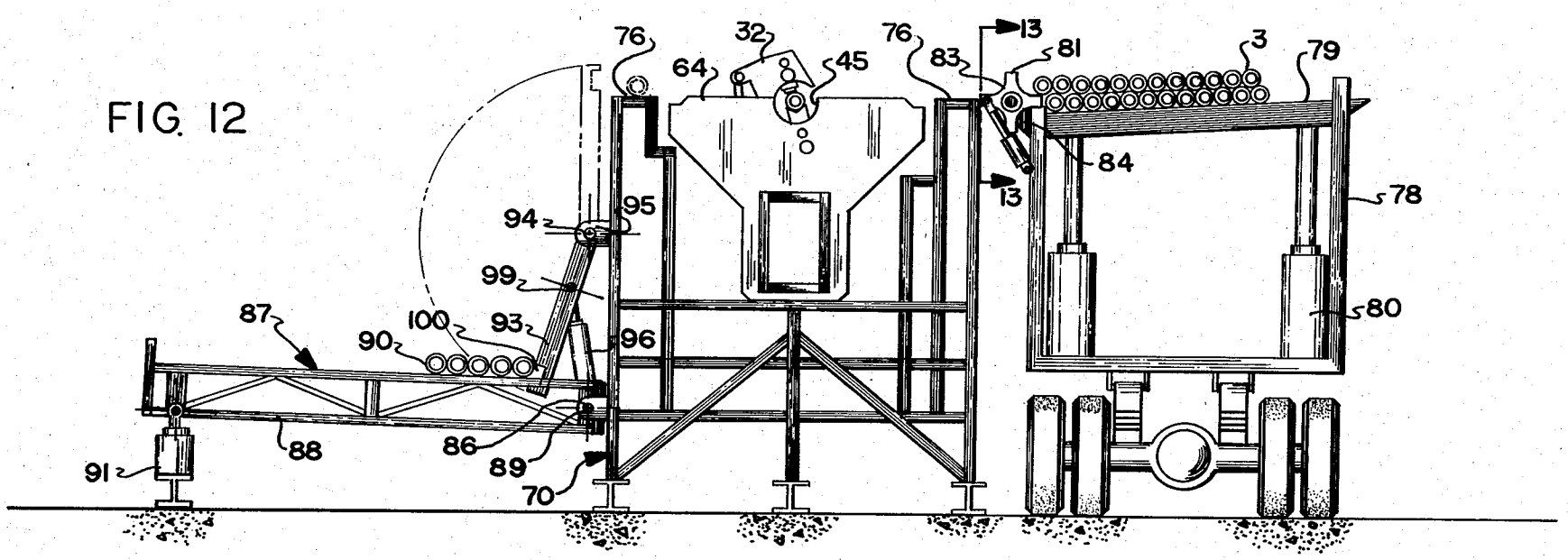
FIG. 12 is a diagrammatic view looking in the direction of arrows 12—12, FIG. 1 showing the improved pipe loading and unloading arrangement in combination with the pipe supply mast shown in dot dash lines mounted within the support frame.
Figure 13:
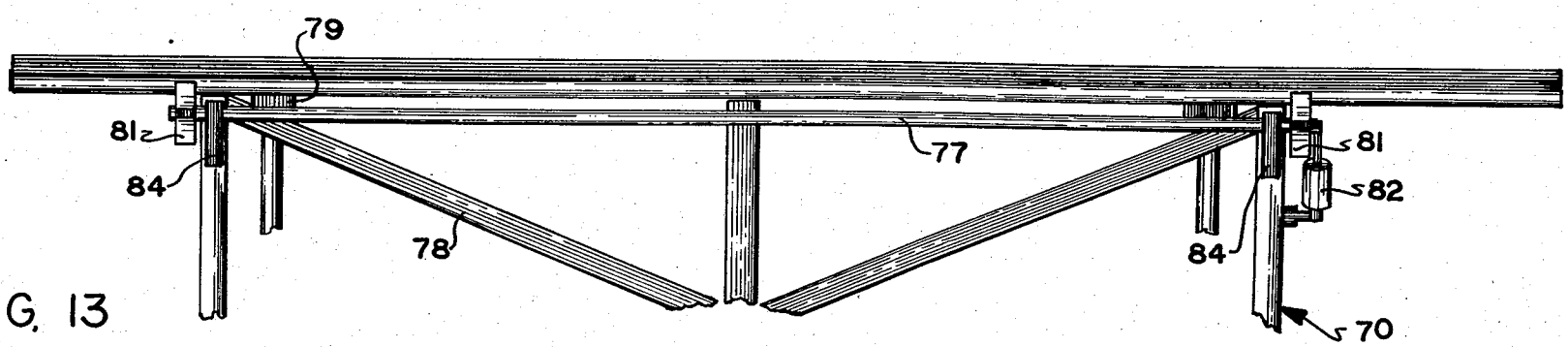
FIG. 13 is an elevational view of the transfer indexing wheel for the drill pipe sections looking in the direction of arrows 13—13, FIG. 12.

In accordance with still another feature of the invention, a pipe casing transfer mechanism indicated generally at 87, is located on the opposite side of transfer mast frame supporting assembly 70 from pipe trailer 78 (FIG. 12). Casing transfer mechanism 87 includes a casing support rack 88 which is pivotally mounted by pins 89 on brackets 86 which are connected to frame assembly 70 for supporting a plurality of pipe casings 90. Rack 88 is inclined downwardly toward frame assembly 70 by a hydraulic cylinder 91 attached to the outer end of rack 88. A pair of spaced lifting arms 93 are pivotally mounted by pins 94 to brackets 95 mounted on frame assembly 70. Arms 93 are pivotally moved with respect to bracket 95 by pressure cylinders 96 which are pivotally mounted by pins 89 to bracket 86 beneath bracket 95. The extended ends of piston rods of cylinders 96 are pivotally connected by pins 99 to a midpoint of lifting arm 93.

The switching end of each arm 93 is formed with a notch 100. A casing 90 rolls down inclined support rack 88 into notches 100 of arms 93. Actuation of cylinders 96 will move arms 93 upwardly from their full line position of FIG. 12 to the dot dash line position, whereupon the casing 90 will be discharged onto top frame member 76. Casing 90 will roll along frame member 76 and onto top edges 64 of pipe clamp assembly plates 24 and into recess 45 and onto pipe holding jaw 42. Movable jaw 35 and plates 32 will be pivoted below plate edges 64 until casing 90 has entered recess 45 whereupon jaw holding plates 32 will pivot from between plates 24 to a clamping position in the same manner as when a pipe section 3 is clamped by pipe clamp mechanisms 26.

The operation of arm 93 will work in reverse for transferring a casing from transfer mast 5 to a stored position on casing support rack 88. During this operation, cylinder 91 will lower casing rack 88 downwardly to enable the transfer casings to roll toward the outer end of rack 88 after arm 93 has moved to its lowered position. Cylinder 91 will lower the outer end of rack 88 to form an outwardly downwardly extending rack.

The improved oil well drilling rig assembly has a number of advantages. The offset arrangement of the lower portion of the transfer mast forms a catwalk between the transfer mast and main drilling mast preventing the possibility of a workman being crushed or injured during movement of the transfer mast toward the main mast. Another advantage is that plates 24 of the improved pipe clamp mounting assemblies, in addition to supporting the pipe clamping mechanisms provide the mounting for the transfer mast sections enabling the transfer mast to be telescopically adjusted to various lengths to accommodate different lengths of pipe sections. Still another advantage is the adjustability of the pipe clamping jaws which enable the jaws to clamp pipes of different diameters and wall thicknesses for transferring the pipe sections between the main mast and a pipe supply rack while maintaining the centerline of the pipe constant regardless of the pipe size, and in addition regulates the clamping pressure to prevent injury to thin wall pipes.

A further advantage is the self-aligning and shock absorbing arrangement between the transfer mast and main derrick mast that is provided by the spaced rubber bumpers or blocks mounted along one side of the main mast which have angled surfaces which mate with complementary-shaped surfaces formed at the corners of the plates of the pipe clamping assemblies, which eliminates any minor transverse misalignment of the transfer mast with respect to the main mast to ensure exact alignment of the pipe sections when delivered to the main drilling mast.

Mast section 16 and 17 can be manually moved in relation to each other and be suitably fixed in association as by use of set screws or the like, as desired. FIG. 5 indicates that the main fixed mast 2 has an open side indicated at 0 in FIG. 5 to facilitate moving the pipe section into association with the drill pipe and permitting ready access to such fixed mast. It also will be appreciated that the plates 24 primarily support the mast section 16 and aid in positioning the telescopic section 17. A walkway w is indicated in FIG. 2 that is formed between the base of the main mast 2 and the support end of the pipe supply mast 5.

Jaws 35 and 42 both are manually adjusted in relation to each other in that the holes 37 in jaw 35 are spaced equal distance from each other which is the same distance as the holes 52 are spaced from each other in jaw 42 and that equivalent holes are used in each of these jaws at all times to maintain the jaws properly on the center line of the drill string.

It also will be realized that the rubber blocks 68 can of course be made from any suitable resilient material normally these blocks must be quite stiff but would have some inherent resiliency or flexibility but would be made from high durometer rubber or plastic materials. If desired, the blocks could even be formed from metal but this would tend to wear and may not have as long of life as use of a plastic material.

Regarding the automatic movement or rolling of the pipe sections across the edges of the space plates 24 as described in relation to FIG. 12, these associated surfaces 76,76 could be slightly higher than the surfaces 64, or some manual push could be given to the pipe sections to cause them to roll to or from the recess 45 or if desired, some other actuator of a conventional type could be provided. Likewise, when pipe sections 90 are lifted up to the frame means they can be moved in any desired manner to get them to roll on to and over the outer surface 64. It will be realized that any desired type of a latch means manually or automatically actuated can be provided on the arms 93 to retain the pipe sections 90 in engagement with this arm when being moved up or down in the rack, as desired.

Accordingly, the improved oil well drilling rig assembly is simplified, provides an effective, safe, inexpensive, and efficient construction which achieves all the enumerated objectives, provides for eliminating difficulties encountered with prior devices, and solves problems and obtains new results in the art.

The description and illustration of the invention is by way of example, and the scope of the invention is not limited to the exact details shown or described. Having now described the features, discoveries and principles of the invention, the manner in which the improved oil well drilling rig assembly is constructed, the characteristics of the construction, and advantageous, new and useful results obtained are set forth in the appended claims.

What is claimed is:

1. An improved oil well drilling rig assembly including:

(a) a main drilling mast having a base and an upper structure, said upper structure being adapted to receive sections of drill pipe;

(b) a pipe supply mast adapted to releasably hold a section of drill pipe, said supply mast having upper, intermediate and lower sections, said lower section being pivotally mounted in a spaced relationship from the base of the main mast for movement between a horizontal pipe receiving position and a raised pipe discharge position; in which the pipe supply mast includes self-alignment means for transversely aligning said supply mast with the main drilling mast when said supply mast is in a raised pipe discharge position, said self-alignment means includes a plate mounted on the supply mast having a pair of angled surfaces formed at opposite edges of the plate; and in which said plate angled surfaces are adapted to slidably engage complementary angled surfaces provided on the main mast to transversely align said masts;

(c) storage rack means for holding a plurality of drill pipe sections; and (d) pipe dispensing means operatively communicating with the pipe supply mast and storage rack means for individually dispensing a pipe section onto the upper section of the pipe supply mast when said supply mast is in horizontal position for subsequent delivery by the supply mast to the upper structure of the main drilling mast.

2. The drilling rig assembly defined in claim 1 in which the angled alignment surfaces on the main mast are formed on blocks of resilient material to absorb shock during the alignment of said masts.

* * * * *